US006241370B1

(12) United States Patent
Bayer et al.

(10) Patent No.: US 6,241,370 B1
(45) Date of Patent: Jun. 5, 2001

(54) MOLDED CHANDELIER LISTELS AND CHANDELIERS INCORPORATING SAME

(75) Inventors: Georg Bayer; Andrew M. Schuyler, both of Plattsburgh, NY (US)

(73) Assignee: Schonbek Worldwide Lighting, Inc., Plattsburgh, NY (US)

( * ) Notice: Subject to any disclaimer, the term of this patent is extended or adjusted under 35 U.S.C. 154(b) by 0 days.

(21) Appl. No.: 09/352,577

(22) Filed: Jul. 12, 1999

(51) Int. Cl.[7] ..... F21S 8/06

(52) U.S. Cl. ..... 362/405; 362/404; 362/405; 362/406; D26/72; D26/80; D26/152

(58) Field of Search ..... 362/404, 405, 362/406, 408, 565, 367; D26/72, 80–91, 146–149, 151–156

(56) References Cited

U.S. PATENT DOCUMENTS 5,873,652 * 2/1999 Bayer et al. ..... 362/405
5,906,430 * 5/1999 Bayer ..... 362/404

* cited by examiner

*Primary Examiner*—Sandra O'Shea
*Assistant Examiner*—Bertrand Zeade
(74) *Attorney, Agent, or Firm*—Wolf, Greenfield & Sacks, P. C.

(57) ABSTRACT

A lighting fixture such as a chandelier formed of a supporting frame member defining a shape of the fixture and a plurality of solid listels or baguettes attached to opposing sides of frame member sections so as to surround and obscure significantly the underlying frame member from view. One or more fasteners may be used to secure the listels to the sections of the frame members. The listels may be produced using commonly available mass production or automated manufacturing techniques. A chandelier having a frame member interposed between glass listels is commonly referred to as a Maria Theresa style chandelier. Alignment features are preferably included on either or both the listels and the frame member to assist in the placement and arrangement of the listels on the frame member for subsequent attachment. Such alignment features may include one or more bosses integral with the section that align with corresponding alignment bores formed in the frame member. Significantly, the listels may be molded to predetermined dimensions and configurations corresponding to dimensions and configurations of the frame members to which the listels are to be attached. Aligned with regions defined by adjacent listels, referred to as listel junctions, are fastening bores for receiving fasteners that are preferably utilized to secure the listels to the frame member as well as to provide a decorative cover for the listel junction. Preferably, the frame member is manufactured, such as by laser cutting, from a flat sheet of malleable material such as sheet metal. Pre-molded listels in combination with a laser cut frame member provides for a simple and accurate manufacturing process that does not require significant labor or time.

21 Claims, 11 Drawing Sheets

MOLDED CHANDELIER LISTELS AND CHANDELIERS INCORPORATING SAME

FIELD OF THE INVENTION

The present invention relates generally to chandeliers and, more particularly, to Maria Theresa style chandeliers.

RELATED ART

A chandelier is typically formed of a frame member from which a plurality of glass or crystal ornaments are suspended to form an overall ornamental appearance. One type of conventional chandelier is known as the "Maria Theresa" style chandelier. The Maria Theresa style (sometimes referred to as the "Maria Therese" style) is one of the most well-known chandelier styles. Originally manufactured by the Josef Palme Company in 1746 for the Austrian Empress, this style of chandelier continues to be popular today and is manufactured by many companies worldwide.

The Maria Theresa style chandelier is characterized in part by a frame assembly having one or more rigid frame members that are bent into various shapes to create the shape of the chandelier. Maria Theresa chandeliers are further characterized by glass parts, referred to as "listels" or "baguettes" attached to the frame members. Listels typically have a narrow rectangular profile and are attached to opposing sides of the frame members. The relative dimensions of the listels and frame members are such that the surrounding glass listels obscure the underlying frame member from view, giving the appearance of a chandelier that is constructed entirely of glass.

FIGS. 1A and 1B are top and side cross-sectional views, respectively, of a portion 100 of an exemplary conventional Maria Theresa style chandelier. The illustrated portion 100 includes hollow glass listels 111A–111D attached to opposing sides 103 and 104 of a metal frame member 112. Frame member 112 is one of many interconnected frame members that form the frame assembly of the chandelier. Each glass listel 111A–111D has a channel 114A–114D, respectively, formed therein. Each channel 114 runs parallel to the axis of its corresponding listel 111. FIGS. 1C and 1D are side and top views, respectively, of a single listel 111A in isolation illustrating channel 114A running therethrough. Generally, listels 111 are considerably shorter than the frame member 112 to which they are attached. Thus, oftentimes, multiple listels 111 are attached to the same side of each frame member 112 in a linearly adjacent relationship. This is shown in FIGS. 1A and 1B by listels 111C and 111D attached to frame member side 103 and listels 111B and 111A attached to frame member side 104. Thus, each pair of listels 111A, 111D and 111B, 111C form a listel pair 102A, 102B that surrounds a section of frame member 112. Between neighboring listel pairs 102 are intermediate regions referred to herein as listel junction 106. Since the illustrative example has listels 111 arranged in a linear adjacent relationship, a listel junction 106B is formed between listel pairs 102A and 102B. In the illustrative embodiment, each frame member 112 also has bores or passageways 118 running crosswise through frame member 112 between or connecting opposing sides 103 and 104 of frame member 112. As shown in FIGS. 1A and 1B, bores 118 of frame member 112 are aligned generally with listel junctions 106.

Listels 111 are attached to frame member 112 via threading wires 113 and fasteners 115. Threading wires 113 are threaded through listel channel 114 of each listel 111 to be attached to one side of frame member 112 and, after exiting a first listel 111, passes through bore 118 to continue running through a second listel 111 to be attached to an opposing side of frame member 112 of an adjacent listel pair 102. Listels 111 on the opposing side of frame member 112 are attached in the same manner. Thus, two threading wires 113A, 113B are passed through each frame member bore or passageway 118 as the threading wires travel along alternating sides of frame member 112.

Rosettes 115A–115L are attached to frame member 112 via pigtails 116. Rosettes 115 are attached to all four sides of frame member 112 at each listel junction 106. Thus, fasteners 115 provide a decorative covering for each listel junction 106 and further secure listels 111A–111D to frame member 112. In such conventional Maria Theresa designs, pigtails 116 are sometimes used as suspension points for crystal trimmings or other decorative ornaments on the chandelier. Electrical wires that provide power to electrical sockets (not shown) run along frame member 112 and are secured thereto with fasteners 115 alone or in combination with other known conventional techniques.

FIGS. 2A and 2B are top views of large glass tubes from which listels 111 are formed. Production of listels 111 begin typically by blowing and manually bending a large curved glass tube 200. Glass tube 200 may be formed in any desired shape such as a circle as shown in FIG. 2A, a FIG. 8 as shown in FIG. 2B, or some other configuration. Glass tubes 200 are extruded with channel 114 running lengthwise through the approximate center of glass tubes 200 to later accommodate threading wire 113. Glass tubes 200 are subsequently cut into individual listels 111, each such listel being formed from predetermined sections of glass tube 200. Thus, sections of glass tube 200 correspond to the sizes and shapes of listels 111 subsequently attached to used frame members 112 of the Maria Theresa chandelier.

Manufacturing and construction of a conventional Maria Theresa chandelier is a very time consuming and labor-intensive process. The blowing and extrusion process is performed manually and is often a tedious and error-prone process. In addition, it is difficult to manually produce numerous glass tubes 200 which all have the same dimensions. It is not uncommon, for example, for a glass tube 200 to have a non-uniform thickness along its lengths if it is not manufactured by skilled craftsman. The labor-intensive process to extrude, hand-bend and hand-cut tubular glass listels also results in a considerable part failure rate and waste produced.

Once the listels are manufactured, the painstaking process of wiring the listels to the frame members is extremely labor intensive and time consuming. For example, the threading wire 113 must be passed through each listel 111, through passageway 118 to the opposing side of the frame member, threaded through the listel on the opposing side of the frame member, and so on. All listels must be secured in this manner before the threading wires are secured with the pigtails 116 and fasteners 115. Thus, virtually every step and the manufacturing and assembly of a conventional Maria Theresa style chandelier is performed manually. As a result labor accounts for a significant portion of the costs of a conventional Maria Theresa chandelier.

SUMMARY OF THE INVENTION

The present invention is directed to a lighting fixture such as a chandelier or lighting fixture component ("lighting fixture") and methods for making the same. The lighting fixture includes a supporting frame member assembly defining a shape of the fixture and a plurality of molded listels or baguettes (referred to herein as "listels") attached to opposing sides of frame member sections so as to surround and obscure significantly the underlying frame member from view. The use of solid molded listels eliminates the labor-intensive operations currently employed to extrude, hand bend, and hand cut tubular listels. The listels of the present invention may be produced using commonly available mass production or automated manufacturing techniques, thereby reducing the manufacturing time and associated labor costs as compared to convention manufacturing processes. In addition, the use of solid listels reduces the part failure rate and waste produced. Furthermore, the resulting listels have more accurate dimensions, ensuring the quality and appearance of the resulting lighting fixture. A lighting fixture having a construction of a frame member assembly, typically metal, surrounded by glass listels is, as noted, referred to in the industry as a Maria Theresa design. Significantly, the listels maybe molded to predetermined dimensions and configurations that correspond to the dimensions and configuration of the frame member to which the listel is to be attached. This provides for the ability to create frame assemblies with frame members having such predetermined dimensions and configurations to which pre-molded listels maybe easily attached. The disclosed aspects of the invention, summarized below, are directed to a chandelier of such a design incorporating elements of the present invention. It should be understood that these aspects of the invention are exemplary only and are to be considered non-limiting.

Alignment features are preferably included on either or both the listels and the frame member to assist in the placement and arrangement of the listels on the frame member for subsequent attachment. Such alignment features, if included on the listels, may be formed in the listels during the molding process or subsequently attached to the listels. In one embodiment, for example, bosses are formed in the listels that align with corresponding holes formed in the frame member facilitate arrangement of the listels during manufacturing. The alignment features may be temporary. For example, the alignment features may be used to align the listels and the frame member temporarily and be removed after the listels are secured to the frame member using fasteners, as described in more detail below.

In certain aspects of the invention between the predetermined frame member sections and corresponding listel pairs are regions referred to herein as listel junctions. Multiple such listel junctions may be formed between adjacent listel pairs along the same or mating frame members. Fasteners are preferably utilized at such listel junctions to secure the listels to the frame member assembly. Such fasteners may then be designed not only to secure the listels and frame member but also to decoratively cover the listel junction. Preferably the fasteners are constructed and arranged to be attached manually to the frame member and/or listels to facilitate assembly of the Maria Theresa chandelier. The use of such fasteners provides for simple and fast securement of the listels to the frame members. This is a significant advantage over traditional designs that currently use wires threaded through the listels. As noted, such approaches are time consuming and require a significant number of man-hours to assemble just one chandelier. With the present invention, the labor is minimal as the listels are quickly and easily arranged on the frame member and the fasteners are hand-applied to secure the listels.

In one embodiment, for example, adjacent listels meeting at each listel junction are spaced from each other. Bores are pre-formed in the frame member to align with the listel junctions. In this embodiment, the fastener is formed of a head region having a decorative side and an underside with a boss extending from the underside. The boss has a length that enables it to extend past the listels into the frame member hole to attach the fastener to the frame member. Such attachment may be achieved with threads or otherwise, such as with configurations that provide a snap-fit. The head of the fastener is configured to extend over each of the adjacent listels meeting at the listel junction. Securing the fastener to the frame member thereby secures the listels between the fastener head region and the underlying frame member. Preferably, the fastener is configured to obscure completely the intermediate space between joining listels. It should be understood that any configuration of fasteners may be implemented. For example, decorative or non-decorative fasteners may be used to secure each listel to the frame member. To provide the appearances similar to conventional Maria Theresa style chandeliers, fasteners having head regions in the form of rosettes are used. Alternatively, rosette ornaments are attached to fasteners.

Preferably, the frame member is manufactured from a flat sheet of malleable material such as sheet metal. Such a material is preferably laser cut. Pre-molded listels in combination with a laser cut frame member assembly provides for a simple and accurate manufacturing process that does not require significant labor or time.

Various embodiments of the present invention provide certain advantages and overcome certain drawbacks of the conventional techniques for manufacturing and assembling Maria Theresa style chandeliers. Not all aspects or embodiments of the invention share the same advantages and those that do may not share them under all circumstances. This being said, the present invention provides numerous advantages including the noted advantage of decreasing the time and cost associated with the production of Maria Theresa style chandelier. Specifically, embodiments of the present invention can be formed to achieve any design goal, including the conventional Maria Theresa chandelier design, with greater accuracy and minimal manufacturing costs as compared to conventional approaches.

In one aspect of the invention a lighting fixture is disclosed. The lighting fixture includes a supporting frame assembly having a plurality of interconnected frame members defining a shape of the lighting fixture. The lighting fixture also includes a plurality of solid listels arranged in pairs secured to opposing sides of the frame members such that each pair of listels surrounds and obscures significantly a section of the frame member to which it is secured from view.

In another aspect of the invention, a listel for use in a Maria Theresa chandelier is disclosed. The chandelier includes a supporting frame assembly defining a shape of the chandelier. The listel includes a solid elongate body member constructed and arranged to be attached to a side of the frame member, wherein pairs of two or more solid listels attached to opposing sides of a section of the frame assembly obscure significantly the frame member section from view.

In another aspect of the invention, a method for manufacturing a chandelier is disclosed. The method includes molding a plurality of solid listels each having a predetermined dimension and configuration; producing a frame assembly including a plurality of interconnected frame members, wherein each frame member has a predetermined dimension and configuration; and securing the plurality of solid listels to the frame assembly such that pairs of two or more listels surround and obscure substantially corresponding sections of the frame members from view.

In a still further aspect of the invention, a method for manufacturing a listel for use in a Maria Theresa chandelier is disclosed. The chandelier has a frame assembly formed from a plurality of integral frame members having predetermined configurations. The method includes molding a plurality of solid listels each having a predetermined configuration that corresponds to one of the configurations of the frame member; and attaching pairs of listels to opposing sides of sections of the frame members having the corresponding configuration.

Further features and advantages of the present invention as well as the structure and operation of various embodiments of the present invention are described in detail below with reference to the accompanying drawings. In the drawings, like reference numerals indicate like or functionally similar elements. Additionally, the left-most one or two digits of a reference numeral identifies the drawing in which the reference numeral first appears.

BRIEF DESCRIPTION OF THE DRAWINGS

This invention is pointed out with particularity in the appended claims. The above and further advantages of this invention may be better understood by referring to the following description when taken in conjunction with the accompanying drawings, in which:

DETAILED DESCRIPTION

The present invention directed to a lighting fixture, such as a chandelier, or a lighting fixture component (generally and collective referred to herein as a "lighting fixture") and methods for manufacturing the same. The shape and appearance of the lighting fixture is defined by a supporting frame assembly that includes one or more interconnected elongate frame members each having a predetermined configuration to achieve a desired overall appearance. The lighting fixture also includes a plurality of solid listels or baguettes (referred to herein as "listels") attached to opposing sides of sections of the frame members so as to surround and obscure significantly the underlying frame member section from view.

Numerous styles of lighting fixtures may be manufactured in accordance with the present invention. Aspects and embodiments of the present invention set forth below are described in connection with a Maria Theresa style chandelier. Such a chandelier includes multiple molded listels attached in an adjacent arrangement to one or more frame members of a frame assembly. The use of molded listels eliminates the labor-intensive operations traditionally employed to manufacture Maria Theresa chandeliers. Molded listels may be manufactured using commonly-available automated manufacturing techniques. As such, molded listels may be manufactured to more accurate tolerances, ensuring the quality and appearance of the resulting Maria Theresa chandelier. These and other advantages and features of the present invention are described in greater detail below.

Figure 1A:
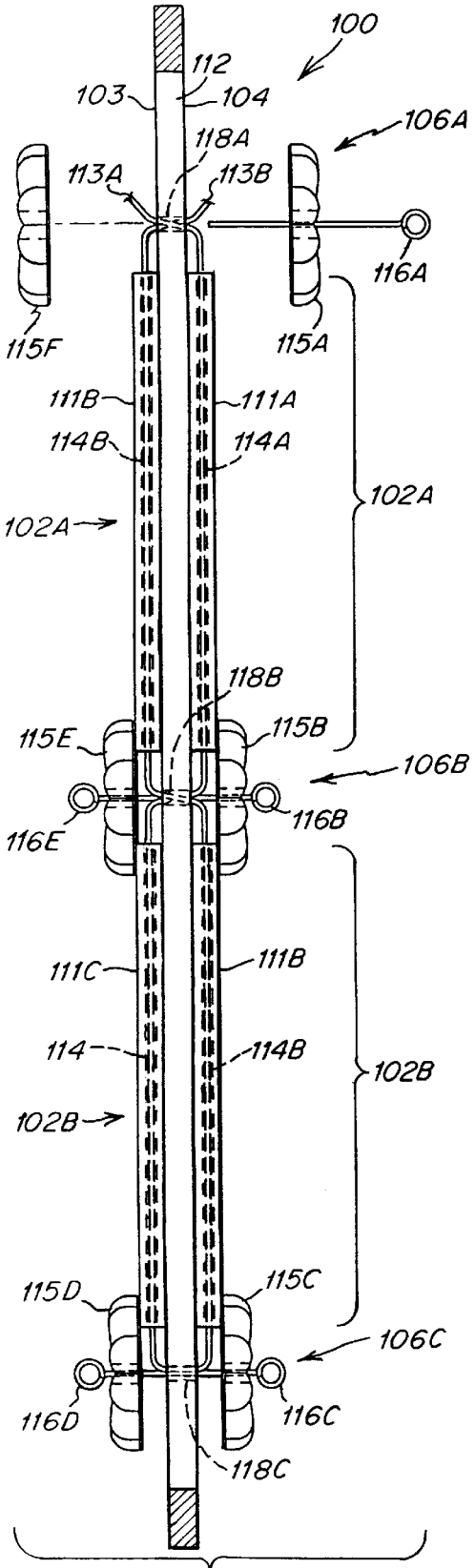
Fig. 1A (PRIOR ART)
FIG. 1A is a top view of a portion of a conventional Maria Theresa style chandelier.
Figure 1B:
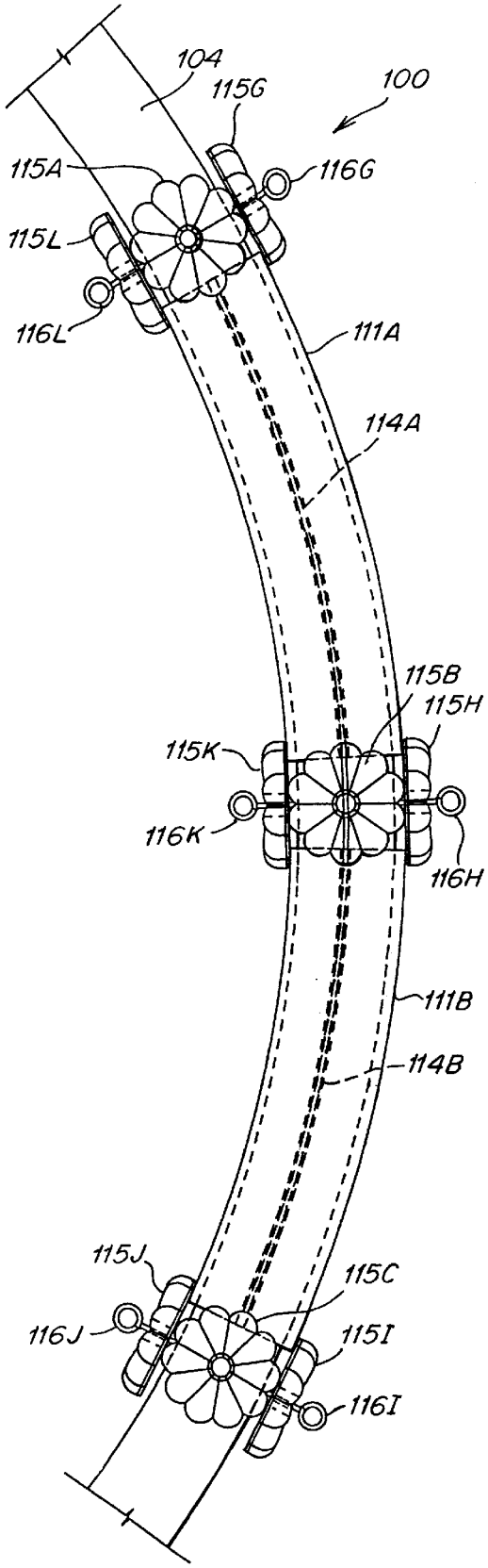
Fig. 1B (PRIOR ART)
FIG. 1B is a side view of the Maria Theresa style chandelier portion shown in FIG. 1A.
Figure 1C:
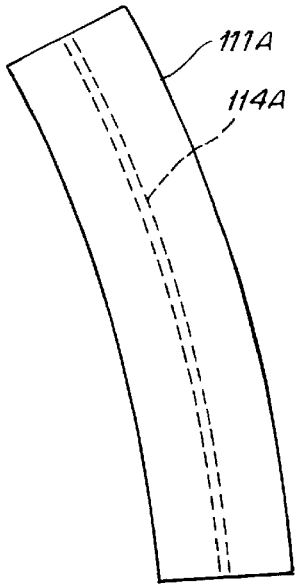
Fig. 1C (PRIOR ART)
FIG. 1C is a side view of a conventional listel used in the Maria Theresa style chandelier illustrated in FIGS. 1A and 1B.
Figure 1D:
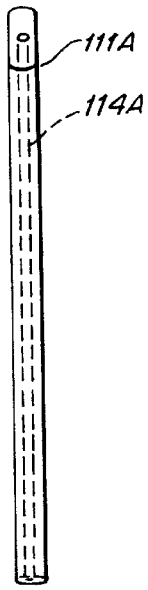
Fig. 1D (PRIOR ART)
FIG. 1D is a top view of the conventional listel illustrated in FIG. 1C.
Figure 2A:
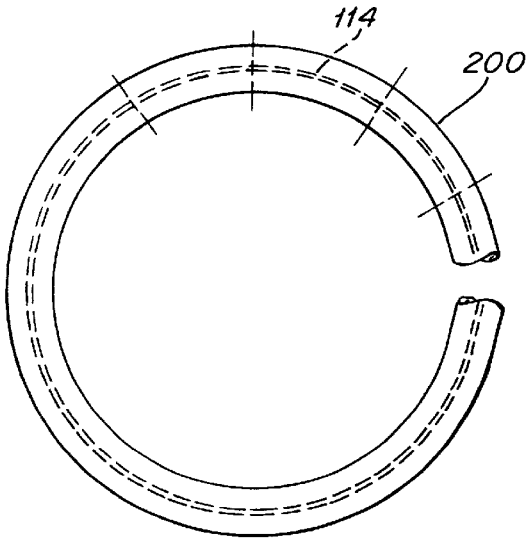
Fig. 2A (PRIOR ART)
FIG. 2A is a top view of one configuration of a blown glass tube to be formed into multiple conventional listels.
Figure 2B:
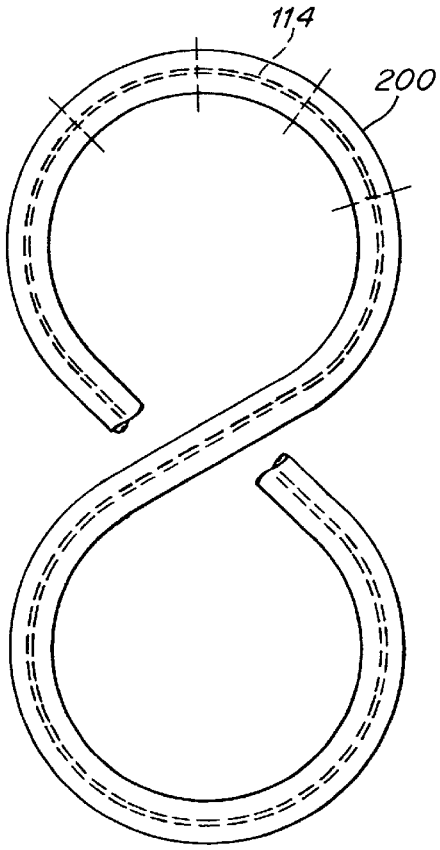
Fig. 2B (PRIOR ART)
FIG. 2B is a top view of another configuration of a blown glass tube to be formed into multiple conventional listels.
Figure 3A:
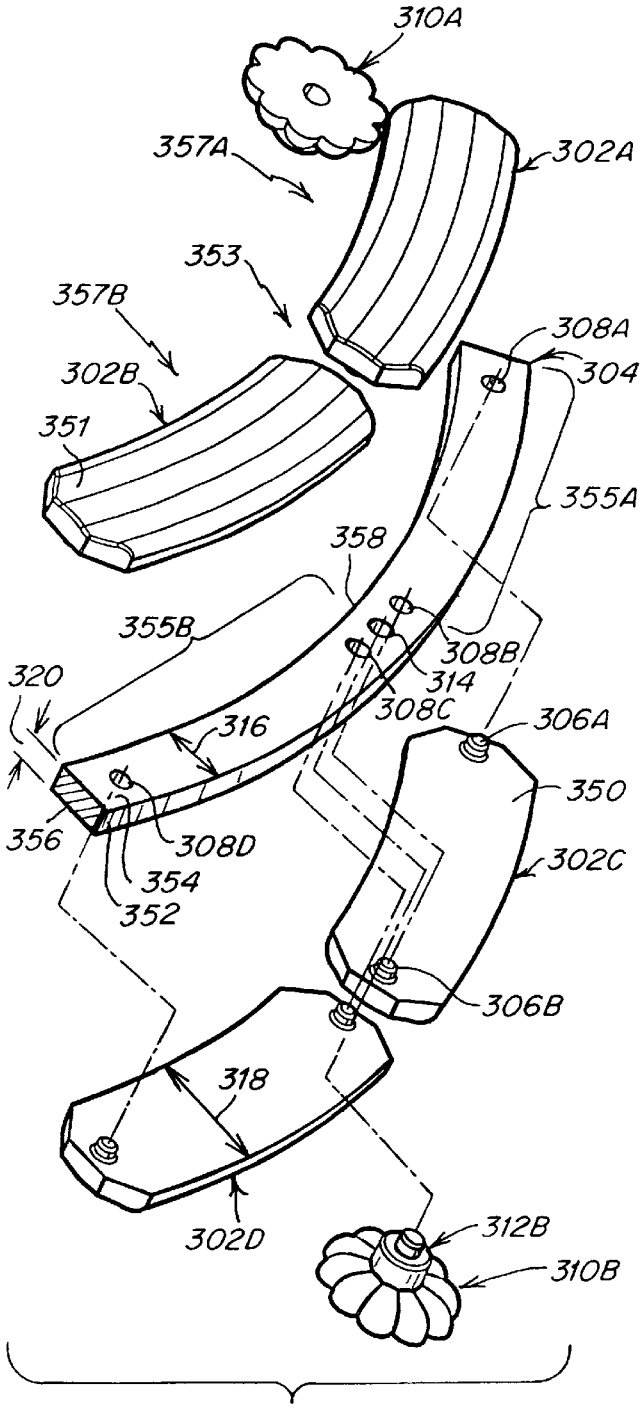
FIG. 3A is an exploded view of a portion of a Maria Theresa style chandelier in accordance with one embodiment of the present invention.
Figure 3B:
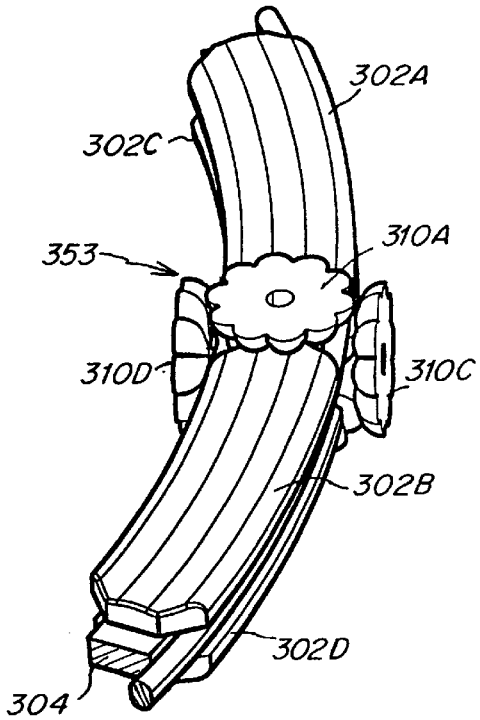
FIG. 3B is a perspective view of the portion of the Maria Theresa chandelier illustrated in FIG. 3A as it would appear on a completely assembled Maria Theresa style chandelier.
Figure 3C:
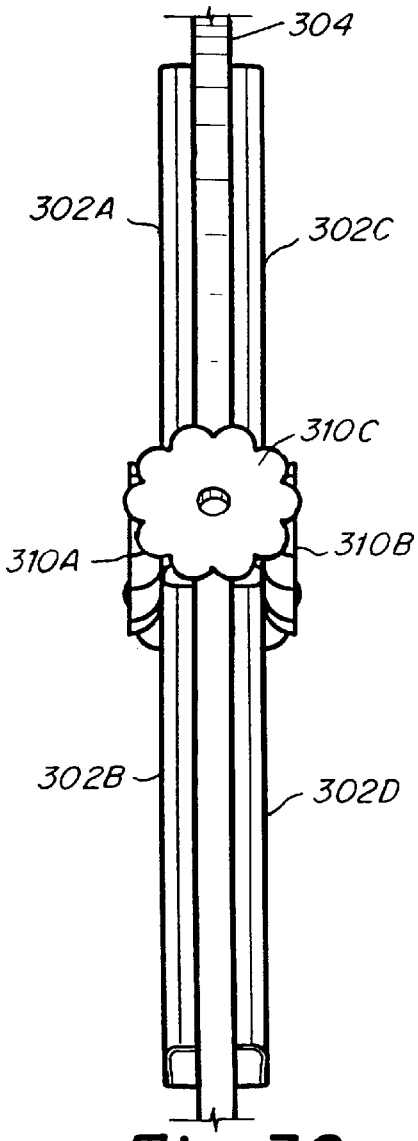
FIG. 3C is a bottom view of the assembled chandelier portion illustrated in FIG. 3B.
Figure 3D:
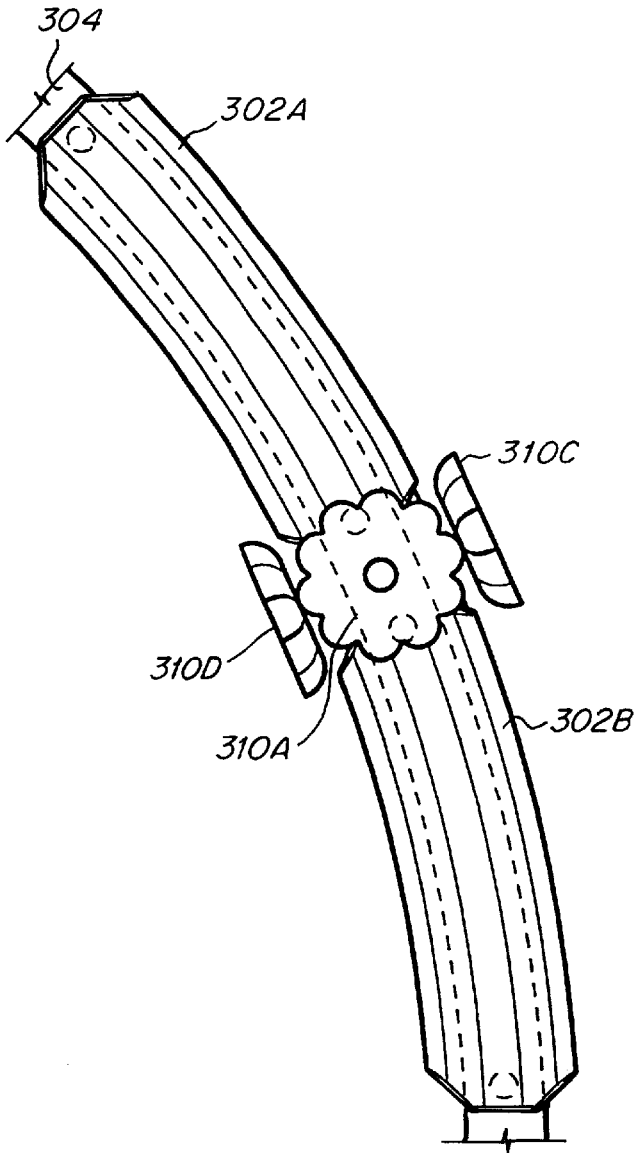
FIG. 3D is a side view of the assembled chandelier portion illustrated in FIG. 3B.

FIG. 3A is an exploded view of a portion 300 of a Maria Theresa style chandelier in accordance with one embodiment of the present invention. FIG. 3B is a perspective view of the same portion 300 as it would appear on a completely assembled Maria Theresa style chandelier. FIG. 3C is a top view while FIG. 3D is a side view of the assembled chandelier portion 300 illustrated in FIG. 3B.

Chandelier portion 300 includes a single rigid supporting frame member 304. As noted, such a frame member is one of many interconnected frame members that together define the shape of the chandelier. In the embodiment illustrated in FIGS. 3A–3D, frame member 304 has a substantially rectangular cross-section and is curved in a single plane. However, it should be understood that frame members incorporated in chandeliers of the present invention may have any cross-section and take on any shape desired, as will be described in greater detail below.

Chandelier portion 300 also includes four elongate molded listels 302A–302D (collectively and generally referred to herein as listels 302). Listels 302 are attached to one of the two opposing sides 354, 356 of a section of frame member 304. In this illustrative example, the length of individual listels 302 is less than the length of frame member 304. Accordingly, listels 302 are arranged adjacent to each other along the length of frame member 304. For example, listel 302A is adjacent to listel 302B on side 354 of frame member 304. Similarly, listel 302C is adjacent to listel 302D on the opposite side 356 of frame member 304. Thus, when attached to frame member 304, listels 302 form opposing pairs. One opposing pair 357A of listels includes listels 302A and 302C attached to section 355A, while the other opposing pair 357B of listels includes listels 302B and 302D attached to section 355B. Accordingly, as used herein, a frame member section 355 is that portion of a frame member 304 to which a listel pair 357 is attached. In FIG. 3A, then, frame member 304 includes two sections, 355A and 355B to which listel pairs 357A and 357B, respectively, are attached.

In one embodiment, listels 302 are positioned with a bottom surface 350 (shown with respect to listel 302C) that at least partially contacts surface 354 or 356 of frame member 304. In the illustrative embodiment, frame member 304 has a substantially rectangular cross-section with substantially flat sides 354, 356 onto which listels 302 are attached. Accordingly, bottom surfaces 350 of listels 302, which are preferably configured to correspond with frame member surfaces 354, 356, are also substantially flat. The side 351 of each listel 302 is in view when the chandelier is assembled. Listel side 351 preferably includes a decorative shape, design or other feature or features that provides the desired ornamental appearance. For example, listel side 351 may include engravings, may be beveled, or may include hooks or other features to which other ornamental elements may be connected.

Listels 302 and frame member 304 are constructed and arranged such that listels 302 surround and obscure significantly underlying frame member 304 from view when the chandelier is assembled. In the exemplary embodiment illustrated in FIGS. 3A–3D, frame member 304 and listels 302 have substantially rectangular cross-sections (ignoring the ornamental design on listel side 351). This is achieved by molding listels having a width 318 that is substantially greater than width 316 of frame member 304 to which they are attached. That is, frame member 304 has a width 316 defining the area of frame member surfaces 354, 356 onto which listels 302 are attached. Listels 302 have a corresponding width 318 (shown with respect to listel 302D in FIG. 3A) that is sufficiently greater than width 316 of frame member 304 so as to extend beyond the top 352 and bottom 358 of frame member 304 when attached thereto. It should be understood that other approaches to ensuring frame member 304 is significantly obstructed from view may be implemented in accordance with the teachings of the present invention. For example, listels 302 may be molded so as to surround all or a substantial portion of top and bottom surfaces 352, 358 of frame member 304. Alternatively, multiple pairs of listels may surround a same frame member section. For example, 2 pairs of listels may be attached to and surround opposing sides of rectangular frame member 304. One, two or three listel pairs may be used to surround a hexagonal frame member, etc. Alternative embodiments of frame members and their associated listels are described below.

Figure 4A:
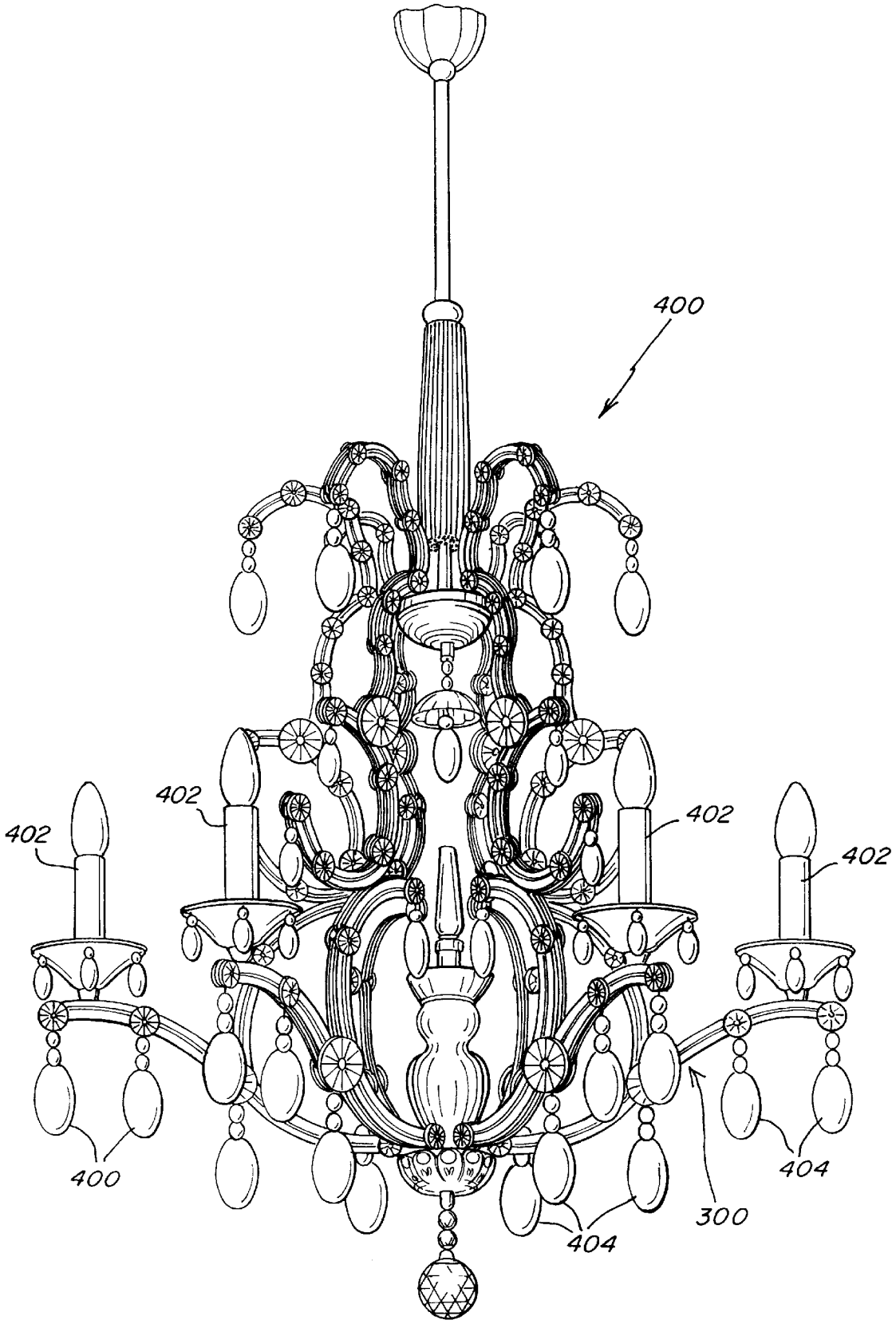
FIG. 4A is an illustration of an assembled Maria Theresa style chandelier in accordance with one aspect of the present invention.
Figure 4B:
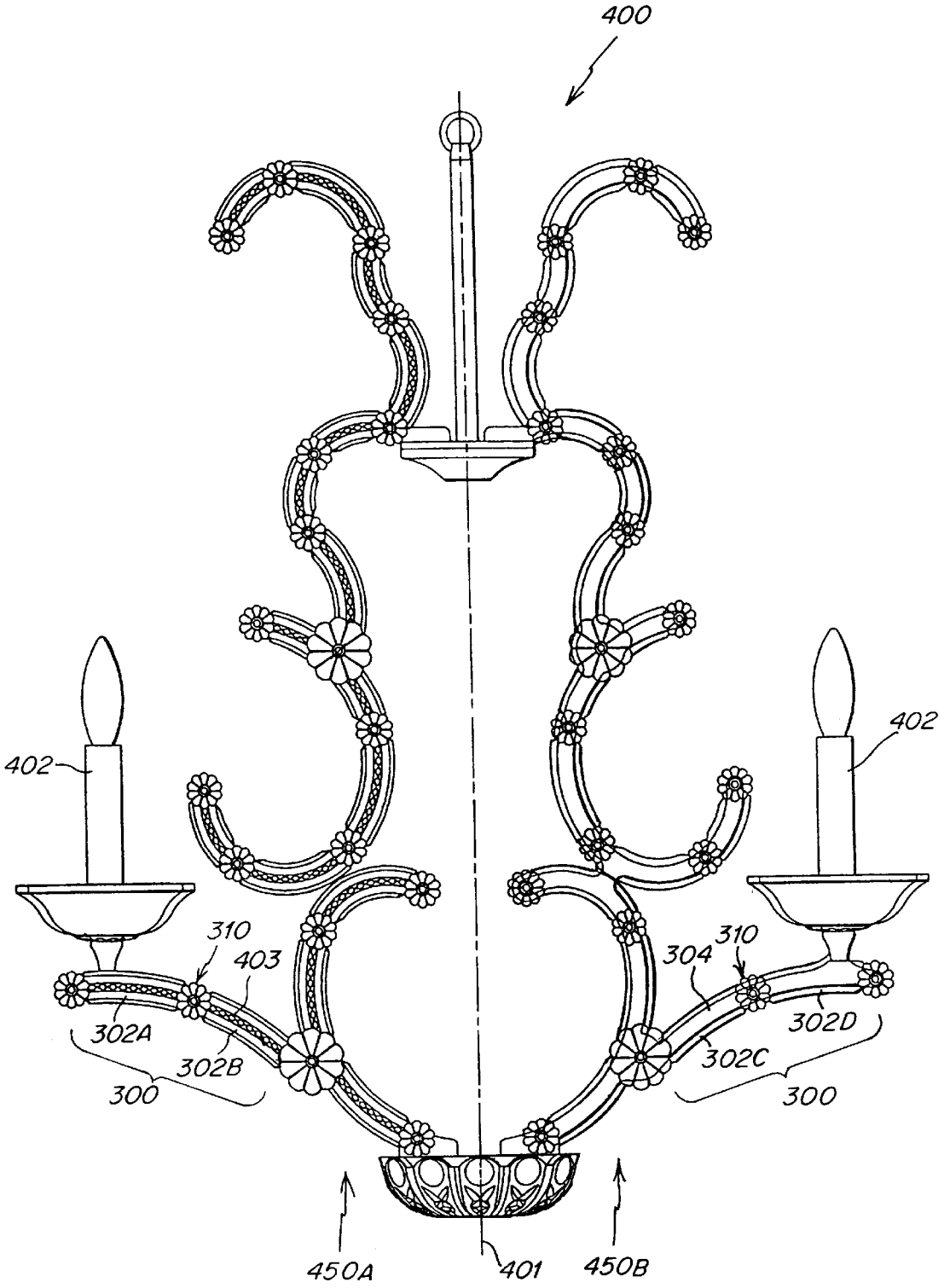
FIG. 4B is a schematic view of a portion of the Maria Theresa chandelier illustrated in FIG. 4A.

FIG. 4A is an illustration of an assembled Maria Theresa style chandelier 400. Each portion 300 may have crystals 404 and/or light sockets 402 attached thereto. As shown, the Maria Theresa chandelier may have arms or body sections in many different shapes and configurations forming what may be a very elaborate lighting fixture. FIG. 4B is a schematic view of a portion of the Maria Theresa chandelier 400 illustrated in FIG. 4A. Chandelier portion 300 described above with respect to FIGS. 3A–3D is shown as it would appear on the left and right sides of chandelier 400. This Figure illustrates two similar sides 450A, 450B of chandelier 400 separated by a dashed line 401. To the left of dashed line 401 chandelier 400 is shown assembled (excluding crystals 404). As shown, listels 302 have molded ornamentation 403 formed therein. On the right side 450B of dashed line 401, the Maria Theresa chandelier 400 is shown with the listels facing the viewer removed thereby exposing the underlying frame member 304. The rosettes (described below) are illustrated transparently to further illustrate the interconnection between frame members 304 and listels 302.

Referring again to FIGS. 3A–3D, in certain embodiments, temporary or permanent alignment features are provided to facilitate the assembly of chandelier components. Such alignment features temporarily assist in the placement or arrangement of listels 302 on frame member 304 and, preferably, securing temporarily the listels and frame members until other processes may be performed or devices added to secure permanently listels 302 and frame members 304. This is particularly useful in Maria Theresa chandeliers such as that illustrated in FIGS. 4A and 4B. As noted above and shown therein, frame members 304 typically form extension arms attached and extending from a center column to form a frame assembly that can be very elaborate. Accordingly, to facilitate attachment of listels 302 to such suspended surfaces, alignment features are preferably provided to hold temporarily listels 302 in place, preventing them from falling from frame member 304 to which they may be attached. The fasteners may then be utilized subsequently to secure permanently listels 302 and frame members 304. As will be described in detail below, fasteners 310 are preferably manually operated, preferably without tools, and as such attach easily to either frame member 304 and/or listels 302. As such, in combination with the alignment features, listels 302 may be attached to frame member 304 quickly and easily with a single hand, without having to do so immediately upon placing listels 302 against frame members 304, and with having access to only one side of the frame member. Such alignment features may be included on listels 302, frame member 304, or both, to assist in the placement and arrangement of listels 302 on frame member 304 for subsequent attachment. Such alignment features, if integral parts of listels 302, may be formed in listels 302 during the molding process, attached subsequently to listels 302, or any combination thereof. In the illustrative embodiment described herein, the alignment features are provided in the form of bosses 306 integral with and extending from surface 350 of listels 302. Such an alignment feature also includes corresponding alignment holes 308 formed in frame member 304. Bosses 306 and alignment holes 308 are constructed to be of relative sizes such that when bosses 306 are aligned with holes 308 and listels 302 are pressed against frame member 304, bosses 306 are removably retained in alignment holes 308, thereby restraining temporarily listels 302 to frame member 304. In the particular embodiment illustrated in FIG. 3A, a thickness 320 of frame member 304 and a depth of alignment holes 308 are at least twice the length of bosses 306. This allows listels 302 to be secured to opposing sides 354, 356 of frame member 304 using the same alignment holes 308.

In the embodiment illustrated in FIGS. 3A–3D, listels 302 are elongate. In such embodiments, two spaced bosses 306 are preferably formed in each listel 302. However, it should be understood that any number of bosses 306 may be used. For example, in embodiments wherein listels 302 are not elongate but rather have a circular, square or other symmetric or balanced shape, a single boss 306 may be sufficient. It should also be understood that in alternative embodiments, the alignment features may take on any desired configuration. For example, in one embodiment, the alignment features may include extension arms extending from the bottom surface 350 or sides of listels 302 that wrap around the top or bottom 352, 358 of frame member 304. Such extension arms may be permanent or temporary. Other mechanical devices such as hooks, slots, tracks, corresponding protrusions and recesses, etc., may be used. Furthermore, in other embodiments, non-mechanical techniques may be used. For example, temporary adhesives or use of particular materials for frame member 304 and listels 302 that cause them to adhere, at least temporarily, to each other, may be used. Still other techniques such as using embedded magnets and metal frame members, or the like may be used. Thus, it should be understood that not only are such alignment features optional, any such alignment features may be used depending upon the conditions under which the listels must be attached to the underlying frame members. This includes, for example, the stage of the manufacturing process at which listels 302 are attached as well as the configuration of the chandelier frame members 304. For example, if listels 302 were to be attached to frame members that are laying flat; that is, upward-facing, horizontal surfaces 354 and 356, then such alignment features do not necessarily have to secure listels 302 to frame member 304 in a manner that would prevent them from falling. However, such alignment features may be desired simply to facilitate the placement of listels 302 on frame member 304.

Figure 3E:
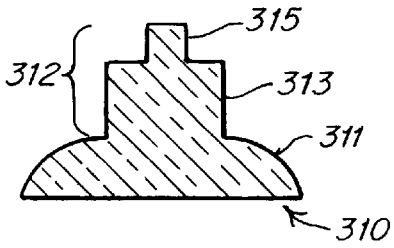
FIG. 3E is a cross-sectional view of one embodiment of a fastener of the present invention.
Figure 6A:
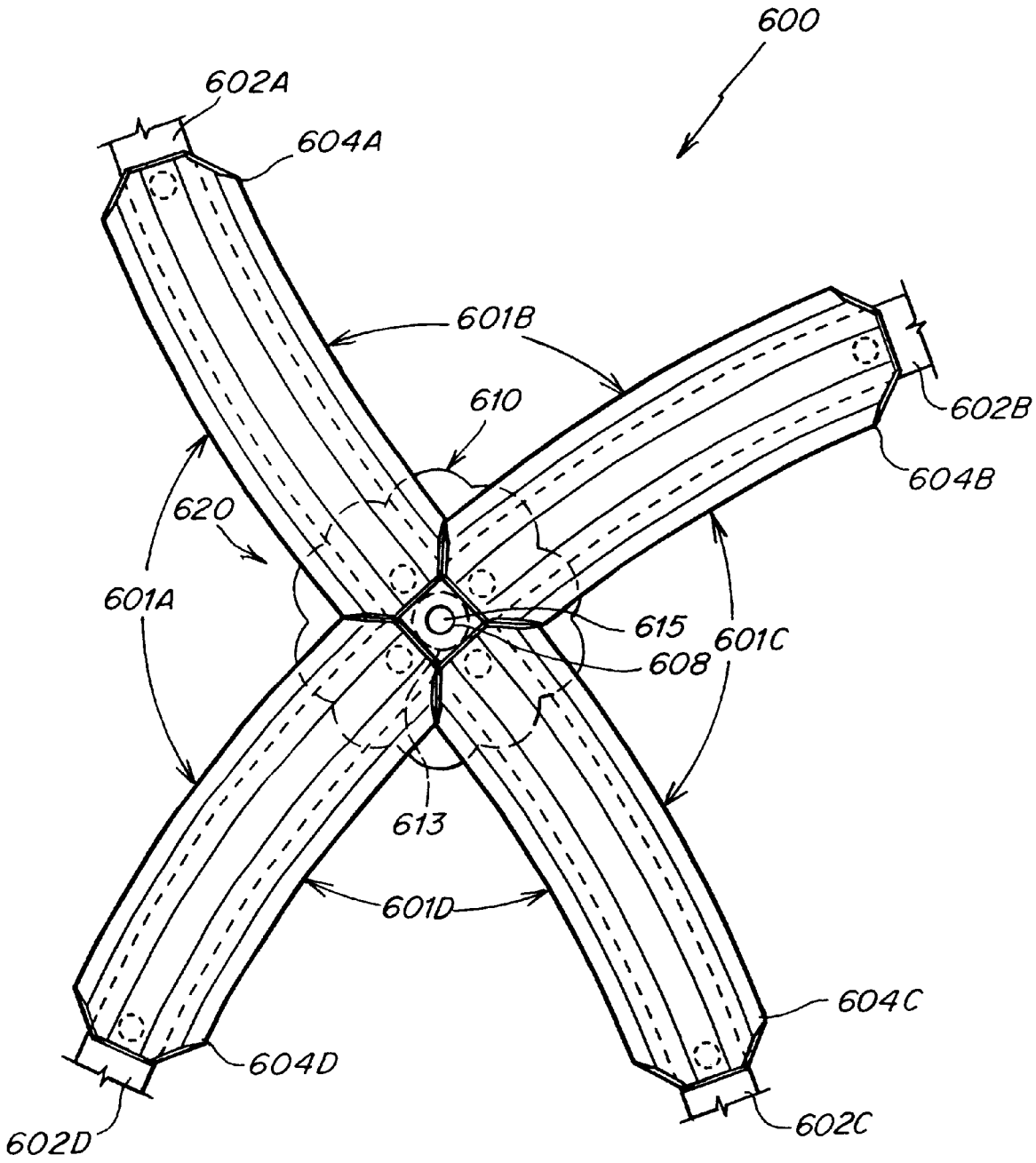
FIG. 6A is a bottom view of listel junctions in accordance with one embodiment of frame members and listels of the present invention.
Figure 6B:
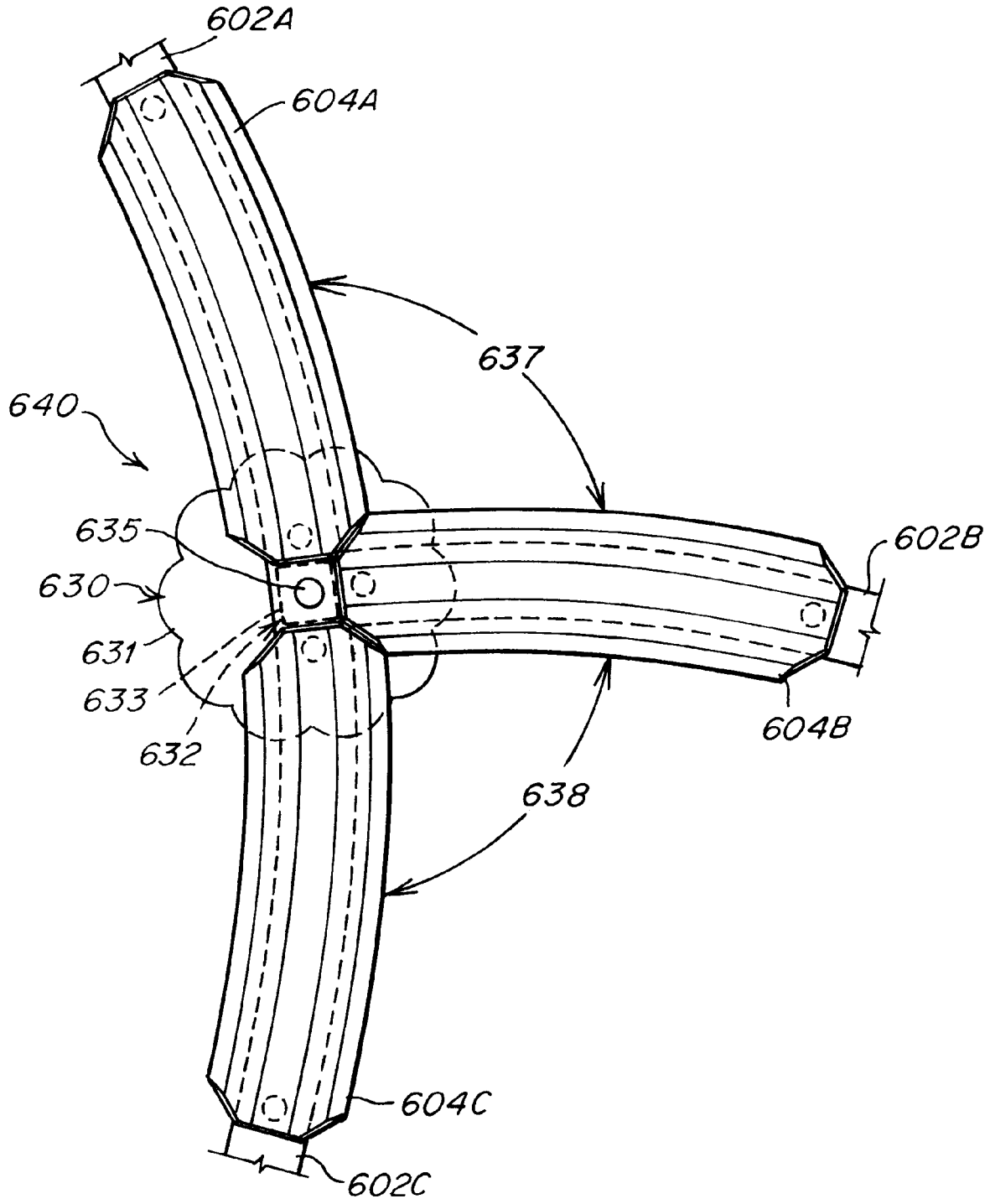
FIG. 6B is a bottom view of listel junctions in accordance with another embodiment of frame members and listels of the present invention.
Figure 6C:
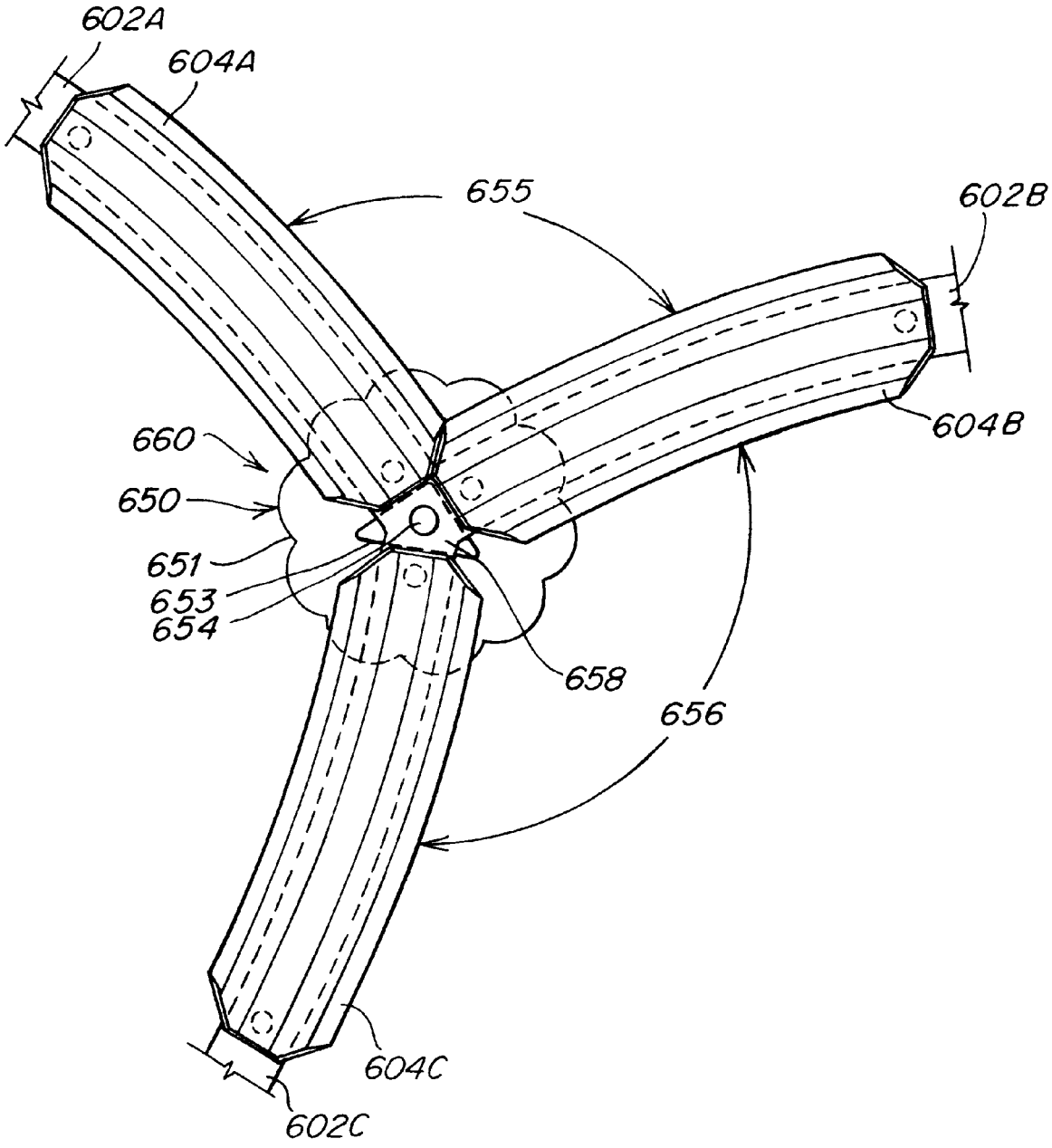
FIG. 6C is a bottom view of listel junctions in accordance with another embodiment of frame members and listels of the present invention.

As noted, one or more fasteners 310 are used to secure listels 302 to frame member 304. Such fasteners 310 may take on any form, as will become apparent from the present disclosure. In the illustrative embodiment, listels 302 are positioned in a spaced-adjacent arrangement with respect to each other when attached to frame members 304. This intermediate space 353 between two or more adjacent listel pairs is referred to herein as a listel junction 353. Such a listel junction 353 may occur between adjacent listels 302 attached to the same or different frame member 304. FIGS. 6A–6C are bottom views of listel junctions 353 illustrating some of the possible arrangements of listels 302. First, however, one embodiment of the fasteners will be described in detail below with respect to the cross-sectional view illustrated in FIG. 3E and its use in the embodiment of the Maria Theresa chandelier illustrated in FIGS. 3A–3D and 4A–4B. Recall that in the particular embodiment illustrated in FIGS. 3A–3D, there are two linearly adjacent listel pairs on a single frame member 304. As such, a listel junction 353 is established between the two adjacent listel pairs 357A and 357B. Once this particular fastener is described in detail, then various listel arrangements and the resulting variations of such a fastener are described with reference to FIGS. 6A–6C.

It should be understood that the mechanism by which listels 302 are secured permanently to frame members 304 may take on many different forms. Some such arrangements are analogous to those described above with respect to the alignment features. In addition, as one skilled in the relevant art would find apparent, the above alignment features; that is, bosses 306 and corresponding alignment holes 308, may be configured to attach securely listels 302 to frame member 304. However, in other embodiments, such fasteners may be separate devices which are attached to frame member 304 through or around listels 302. In the illustrative Maria Theresa embodiment, fasteners 310 are adapted to extend through listel junction 353 to attach to frame member 304. In such an embodiment, fasteners 310 have a T-shaped cross-section. A top or head region 311 has a diameter sufficient to enable it to extend over a predetermined portion of the listels 302 forming listel junction 353 when fastener 310 is attached to frame member 304. Each fastener 310 also include a boss 312 integral with and extending from a bottom surface of head region 311 to be connected to frame member 304.

Boss 312 may have any configuration that enables fasteners 310 to be easily secured to frame member 304. In the illustrative embodiment, boss 312 is constructed and arranged to connect to fastening hole 314 aligned with listel junction 353. In the embodiment illustrated in FIG. 3E, boss 312 is shown to have two regions. An abutment region 313 proximate to head portion 311 provides abutment surfaces for listels 302. Abutment region 313 is described in greater detail below with references to FIGS. 6A–6C. A securing region 315 distal to head portion 311 inter-operates with frame member 304 to secure fastener 310 to frame member 304. I the embodiment illustrated in FIG. 3E, securing region 315 has a diameter that is less than abutment region 313. Preferably, fastener 310 is attached and detached to/from frame member 304 with minimal manual force. For example, in the illustrative embodiment, securing region 315 of boss 312 is constructed and arranged to snap fit into fastening hole 314. In an alternative embodiment, securing region 315 is threaded as is fastening hole 314. In this embodiment, manual rotation of fastener 310 easily attaches/detaches fastener 310 to/from frame member 304. It should be understood that other embodiments of boss 310 are considered to be within the scope of the present invention.

It should also be understood that fasteners 310 may take on many different forms and utilize many different techniques to secure listels 302 to frame member 304. For example, in the illustrative embodiment, listels 302 are preferably surrounded by fasteners 310 on each side to restrain listels 302 to frame member 304. As shown in FIGS. 3A–3D, four fasteners 310 are used to secure listels 302 to frame member 304. Such an arrangement is preferred in this embodiment since each frame member 304 may be positioned in virtually any orientation in an assembled chandelier, and since fasteners 310 provide a securing force to listels 302.

Fasteners 310 preferably provide a decorative covering for listel junction 353 in addition to securing listels 302 to frame member 304. In the illustrative embodiment, for example, head region 311 of fasteners 310 is configured in the form of a rosette. Such a design is desired to enable fasteners 310 to correspond in appearance to rosettes that are used in conventional Maria Theresa style chandeliers. It should be understood, however, that fasteners 310 may take on many different forms and utilize many different techniques to secure listels 302 to frame member 304. For example, fastening techniques and devices may be incorporated into the alignment features noted above. Alternatively, fasteners 310 may be constructed and arranged to secure a single listel 302 to frame member 304. Such a fastener may be, for example, permanent adhesive, clips, latches, interlocking features, bolts, screws, etc. Other non-mechanical features may also be used. For example, magnetics, chemical bonding and the like may be utilized.

As noted, FIGS. 6A–6C are bottom views of a listel junction in accordance with various embodiments of the present invention. In each Figure, the bottom fastener is removed to clearly expose the adjacent listels forming the illustrated listel junction. Referring to FIG. 6A, four frame member sections 602A–602D are secured to each other to form a frame member assembly 600 having a cross or "X" configuration. Any two or more of frame member sections 602 may form a unitary frame member. For example, frame member sections 602B and 602D can be a unitary frame member to which frame member sections 602A and 602C are secured. In such an embodiment, frame member 602A and 602C are secured to opposing sides of frame member 602B/602D. Regardless, each frame member section 602 has listels secured thereto; that is, listels 604A–604D are attached to frame members 602A–602D, respectively. The four listels 602A–604D are in an adjacent spaced-apart arrangement forming listel junction 620 in the vicinity at which frame members 602A–602D are interconnected. A circular fastening hole 608 is formed in one of the frame members 602 to which fastener 610 is attached. Fastening hole 608 is constructed and arranged to receive securely boss securing region 615 of fastener 610. In this embodiment, abutment region 613 has a circular cross-section. The four listels 604A–604D abut against a tangent point or area of cylindrical abutment region 613 as shown in FIG. 6A.

Figure 7A:
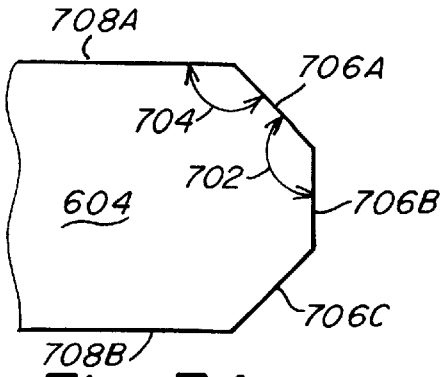
FIGS. 7A–7D is a schematic representations of listels in accordance with various embodiments of the present invention.
Figure 7B:
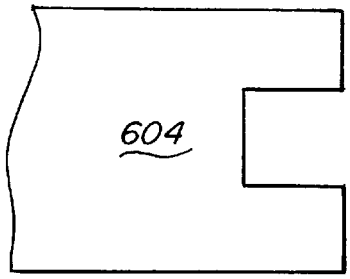
Figure 7C:
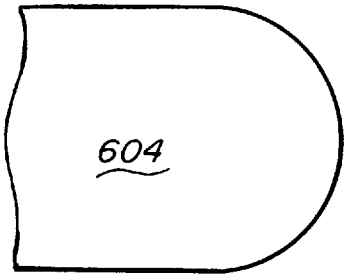
Figure 7D:
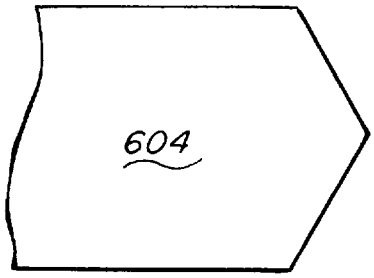

FIGS. 7A–7D are schematic representations of the ends of listels in accordance with various embodiments of the present invention. Referring to the embodiment illustrated in FIG. 7A, listels 604 have half-hexagonal (three-sided) ends. Side 706B is orthogonal to side 708 which is parallel to the axis of listel 604. Sides 706A and 706C each form an interior angle 702 of 135° with side 706B, and angle 704 with sides 708A and 708B. Such an arrangement enables side 706B to abut against abutment region 313 of fastener 310 while providing for the simultaneous abutment of immediately adjacent listels forming the listel junction. It should be understood, however, that the above-noted interior angles determine the angles 601A–601D between adjacent listels 604. Thus, interior angles 702, 704 may be different in alternative embodiments of the present invention. These alternative angles can provide for listel junctions at which frame members and their corresponding listels meet at various angles 601, have spaces therebetween, etc. It should also be understood that the ends of listels 604 may take on other configurations. FIGS. 7B–7D illustrate three alternative configurations including "U" shaped (FIG. 7B), circular (FIG. 7C) and triangular (FIG. 7D.

Returning to FIGS. 6A–6C, FIG. 6B is a bottom view of a listel junction 640 at which an alternative embodiment of the fasteners is illustrated. In this embodiment, a fastener 630 has an abutment region 633 which has a substantial square cross-section integral with a rosette head region 631. Fastener 630 includes a cylindrical securing region 635 similar to securing region 315 described above. Such a configuration of boss 632 provides a greater surface area against which listels 604 may abut when fastened to frame members 602. The shape of the ends of listels 604, along with the shape of abutment region of boss 632, enable any number of listels to form at listel junction 640. In the embodiment shown, three listels form listel junction 640. The angles 637–638 between listels 604A–604C correspond to the underlying frame members 602 the shape of boss abutment region 633 and the curvature of listels 604. In the exemplary embodiment, for example, angle 637 between listels 604A and 604B is greater than angle 638 between listels 604B and 604C.

In another embodiment illustrated in FIG. 6C, a fastener 650 has a rosette head region 651 similar to that described above, and a boss having a triangular abutment region 653 and a circular securing region 654. Three listels 604A–604C are shown attached to frame assembly portion 658 in the shape of a "Y". In this configuration, listels 604A and 604B are immediately adjacent to each other while being in a spaced adjacent relationship with respect to listels 604C. In this configuration, triangular abutment region 653 corresponds with the shape of listel junction 660 to further secure the listels 604 to frame member 602. Angle 655 between listels 604A and 604B is the minimum provided by this configuration due to the shape and relative position of listels 604A and 604B. However, angle 656 is adjustable from approximately 45° where the listels touch each other to some greater angle.

Based on the above, it should become apparent that the angle between adjacent listel pairs is determined by any number of factors including the shape and curvature of the listels, the number of adjacent listels forming the listel junction, the angle between the frame members 304 and the configuration of the fastener boss, etc. Accordingly, any desired arrangement may be achieved by varying any one or more these elements. Thus, the various configurations of the fasteners and listel junctions shown in FIGS. 6A–6C are provided merely for purposes of example only and are not to be considered limiting in any manner. It should be appreciated that a variety of other configurations may be achieved in accordance with the present invention. Such alternative embodiments may incorporate various numbers of listels, each having the same or different shapes or sizes. In each such configuration, appropriate fasteners may be used to fasten the listels to their corresponding frame members, with the listels and frame members being constructed and arranged such that the listels significantly obscure the underlying frame member from view thereby giving an appearance that the lighting fixture is comprised solely of glass.

The use of such fasteners provides for simple and fast attachment of the listels to the frame members. This is a significant advantage over traditional Maria Theresa style chandeliers that currently use threading wires passed through channels in the listels. As noted, such conventional approaches require significant labor costs associated with the assembly of just a single chandelier. Use of the above-noted fasteners in accordance with the present invention significantly minimize the labor associated with the assembly of a Maria Theresa style chandelier (or other lighting fixture). For example, fastening the above-described adjacent pre-aligned listels on their respective frame members by manually operating a fastener provides significant speed and cost savings over conventional Maria Theresa style chandeliers.

As noted, listels 302 are molded pieces, preferably of glass or other transparent or translucent material. For example, in alternative embodiments listels 302 are formed from plastics and plastic composites. Listels 302 are essentially solid elements to the extent that such is possible given the selected manufacturing process and material. For purposes of the present disclosure, then, molded listels 302 are said to be substantially solid listels. This includes embodiments of listels that have holes, channels or other formations for securing the listels to their corresponding frame members. For example, listels 302 may have a channel for receiving a fastener such as a bolt, screw, etc. of the same or different material than the listel itself. In addition, solid listels 302 may include decorative indentations, shapes, carvings and the like to achieve a desired appearance.

The use of solid listels provides the alternative manufacturing processes other than the labor-intensive operations currently employed to extrude, hand-bend and hand-cut tubular glass listels. The listels of the present invention may, for example, be formed using commonly available mass production or automated manufacturing techniques. The use of such techniques reduces the time of manufacture and associated labor costs. This also reduces the part failure rate and waste produced as compared with conventional techniques. Furthermore, the resulting listels are manufactured within greater tolerances, ensuring the quality and appearance of the resulting lighting fixture.

One significant advantage of certain aspects of the present invention is that the molded listels may be manufactured to a plurality of predetermined dimensions to achieve a desired appearance. For example, in one particular embodiment, listels 302 are manufactured to have a plurality of lengths and radii of curvature. For example, listels having three different lengths and two different radii of curvature may be manufacture for use in a particular Maria Theresa style chandelier to achieve a desired appearance. Such listel dimensions would thereby correspond with the underlying frame member sections to which they are attached. Using such predetermined dimensioned listels provides for the ability to create frame assemblies having frame members with component sections of varying lengths and shapes that correspond to the predetermined listel dimensions. This provides for the standardization of component parts of the Maria Theresa style chandelier. In one particular embodiment, the length of the listels is the same as that used in traditional Maria Theresa style chandeliers. In the same or alternative embodiment, the molded listels are manufactured to have dimensions which satisfy the current UL standard 1571.

Preferably, frame member 304 is manufactured from a flat sheet of malleable material such as sheet metal. Such a material may be laser cut as described in commonly owned U.S. Pat. No. 5,588,744, entitled "Gallery Ring Assemblies for Chandeliers" and U.S. Pat. No. 5,906,430, entitled "Crystal Jewel Assembly for Chandeliers," both of which are hereby incorporated by reference herein in their entirety. The listels, which would typically be premolded during the manufacturing and assembly process, will then be readily available to fasten to a frame member 304 manufactured using the laser cutting technique. The use of premolded listels in combination with a laser cut frame member provides for a simple and accurate manufacturing process that does not require significant labor or time.

Figure 5A:
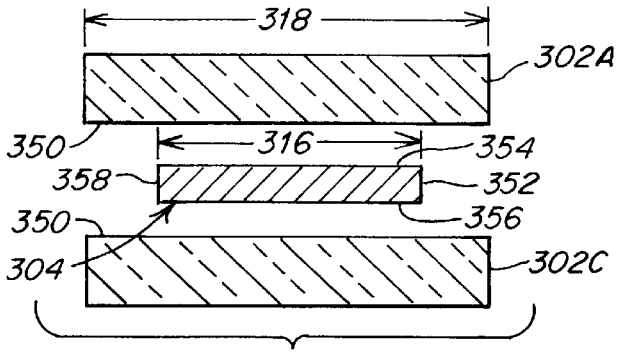
FIG. 5A is a cross-sectional view of one embodiment of the frame member and listels of the present invention.

In the above-described embodiments, particularly the embodiment in which the frame members are laser cut, frame member 304 preferably has a rectangular cross-section. A cross-sectional view of such an embodiment is illustrated in FIG. 5A. As shown therein, frame member 304 is substantially rectangular with substantially flat sides 354 and 356 to which listels 302A and 302C are attached. Accordingly, sides 350 of listels 302 which attach to sides 354 and 356 of frame member 304 are also substantially flat. As noted, listels 302 have a width 318 which is sufficiently larger than width 316 of frame member 304 so as to substantially obscure frame member 304 from view.

Figure 5B:
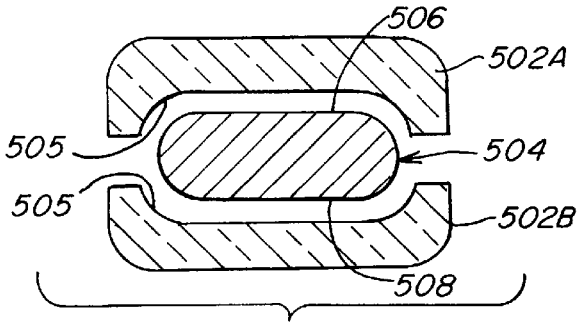
FIG. 5B is a cross-sectional view of an alternative embodiment of the frame member and listels of the present invention.

FIG. 5B is a cross-sectional view of an alternative embodiment of listels 302 and frame member 304. In this embodiment, frame member 504 has a substantially cylindrical cross-section, while listels 502A and 502B have semicircular cross-sections. The inner surface 505 of listels 502 have a radius of curvature substantially the same as that of surfaces 506 and 508 of frame member 504. Thus, when listels 502 are attached to frame member 504, listels 502 extend around frame member 504 to a position at which they are adjacent to or abutting each other. In this way, listels 502 surround frame member 504 sufficiently to obscure significantly frame member 504 from view.

Figure 5C:
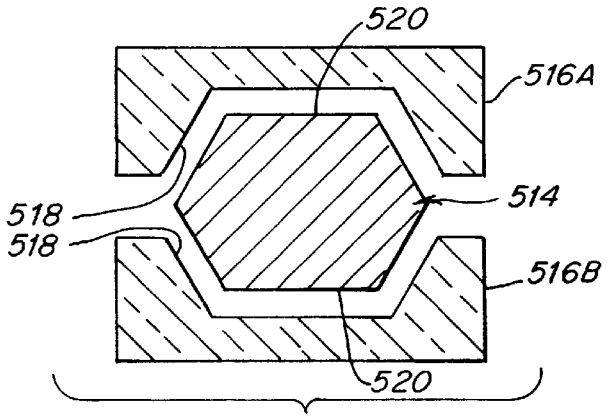
FIG. 5C is a cross-sectional view of an alternative embodiment of the frame member and listels of the present invention.

FIG. 5C is a cross-sectional view of an alternative embodiment of the molded listels and frame members of the present invention. In this embodiment of the invention, frame member 514 has a substantially hexagonal cross-section while listels 516A and 516B have cross-sections which are truncated triangles. Surface 518 of listels 516 are shaped to correspond to sides 520 of frame member 514. Thus, when listels 516 are attached to frame member 514, listels 516 obstruct significantly frame member 514 from view. It should be appreciated that numerous other embodiments of the molded listels and underlying frame members may be provided in accordance with the present invention. All embodiments of such listels of the present invention are easily manufactured as such listels are solid molded elements rather than extruded hand-bent and hand-cut tubular listels conventionally used in Maria Theresa style chandeliers. As a result, any configuration may be achieved using the techniques of the present invention described herein.

Figure 5D:
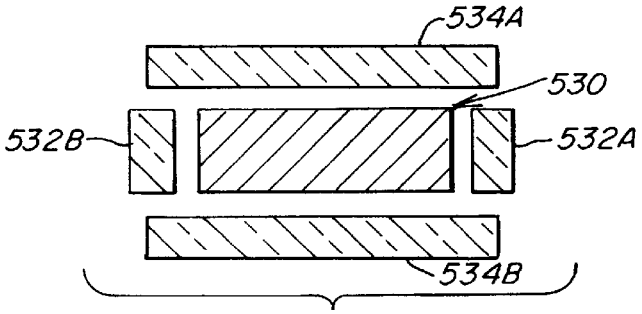
FIG. 5D is a cross-sectional view of an alternative embodiment of the frame member listels of the present invention.

FIG. 5D is an illustration of an alternative embodiment of the listels and frame member of the present invention. In this alternative embodiment, frame member 530 has a substantially rectangular cross section. However, due to the dimensions of frame member 530 use of a single pair of listels on opposing sides as shown in FIG. 5A would result in large and cumbersome listels. In this embodiment, rather, two pairs of listels 532 and 534 are provided, each having listels on opposing sides of frame member 530. Thus, the number of pairs of listels may vary to achieve a desired appearance given a frame member of a particular configuration. In addition, it should be understood that as used herein, the term listel pair may include additional of fewer listels that two presented above. For example, if frame member 530 had a triangular cross-section, three listels may be used to surround the frame member. In such an embodiment, the "pair" of listels includes three listels. It should also be understood that under certain embodiments of a lighting fixture wherein the frame member is obscured from view by another type of device such as when frame member 304 is adapted to be mounted on a wall, only a single listel may be used to obscure substantially frame member 304 from view.

Solid listels of the present invention such as listels 302A–302D illustrated in FIGS. 3A–3D, may be manufactured using any well-known manufacturing process now or later developed. For example, solid listels manufactured in accordance with the present invention may be formed by pressure, injection molding and the like. As noted, in embodiments wherein multiple listels each having different dimensions such as length or radius of curvature are utilized in a single Maria Theresa style chandelier, each of the listels is separately molded using individual molds, or may be cut from a larger molded piece.

Providing a solid listel that is secured to a metallic frame member of a frame assembly has a number of associated advantages. Generating listels by pressing them from glass molds rather than by cutting them from blown glass tubes significantly reduces the time needed to produce the listels necessary for a Maria Theresa style chandelier. Glass blowing is an inherently slower process than molding from one or more pre-designed molds. Furthermore, listels generated from blown glass must be cut from larger shapes into appropriate shapes and sizes, which is a tedious and time consuming process. In contrast, listels generated from molds in accordance with the present invention are produced directly in standard shapes and sizes that do not require additional alteration before they can be attached to a frame member.

Furthermore, pressing listels from molds increases the quality of the listels produced thereby. A listel produced through the molding process generated properly from a mold will have the shape imposed by that mold. In contrast, glass blowing can result in listels that have non-uniform shapes and thicknesses. The quality of listels produced by glass blowing can be improved only at the cost of expending more time to produce each individual listel. In addition, molds with decorate designs can be used to generate listels which have such decorative designs which can enhance the appearance of the resulting chandelier without increasing production time. Addition of such decorative designs to listels using glass blowing would be difficult, if not impossible. As a result, to achieve such design enhancements, additional features and the concomitant processing would be required to add such features to the traditional listels.

A further advantage of one embodiment of the present invention is that the listels may be quickly and easily secured to the frame members of the chandelier. As noted above, securing traditional listels to frame members of conventional Maria Theresa style chandeliers is a time consuming and tedious process involving threading wires through long channels in the listels, cross-threading them through the frame member and extending them through neighboring listels. In contrast, listels manufactured in accordance with the present invention may be quickly and easily secured to the frame members using any number of securing mechanisms.

While there have been shown and described what are at the present considered the preferred embodiments of the present invention, it will be obvious to those skilled in the art that various changes and modifications may be made therein without departing from the scope of the invention as defined by the appended claims.

What is claimed is:

1. A lighting fixture comprising:

a supporting frame assembly having a plurality of interconnected frame members defining a shape of the lighting fixture, each of said frame members having opposing sides; and a plurality of molded listels arranged in pairs, each of said pairs of molded listels secured to opposing sides of a section of one of said frame members such that each said pair of said molded listels substantially surrounds and obscures significantly from view the section of said frame member to which each said pair is secured.

2. The lighting fixture of claim 1, further comprising:

at least one fastener constructed and arranged to secure each of said plurality of listels to said frame assembly.

3. The lighting fixture of claim 1, wherein said plurality of frame members and said listels have a substantially rectangular cross section and wherein each said frame member has at least one side surface defining a width of the frame member, and wherein said plurality of listels have a width that is sufficiently greater than said frame member width so as to extend beyond a top and bottom of said frame member when secured thereto.

4. The lighting fixture of claim 1, wherein said plurality of listels include alignment features to align each of said plurality of listels with a corresponding section of said frame member.

5. The lighting fixture of claim 4, wherein said alignment features comprise:

a boss integral with said listels and extending from a bottom surface thereof; and a corresponding alignment bore formed in said frame member for receiving said boss.

6. The lighting fixture of claim 2, wherein adjacent listel pairs define an intermediate listel junction, and wherein said at least one fastener is adapted to be attached to said frame member at said listel junction so as to secure said plurality of listels to said frame member.

7. The lighting fixture of claim 6, wherein said at least one fastener comprises:

a head region having a decorative side and an underside; and a boss coupled to said underside of said head region.

8. The lighting fixture of claim 7, wherein said head region is in the form of a rosette.

9. A listel for a Maria Theresa chandelier frame assembly including a rigid supporting frame member defining a shape of the chandelier, said listel comprising:

a solid elongate body member constructed and arranged to be attached to a side of the frame member, such that a pair of listels attached to opposing sides of a section of the frame member significantly obscures the frame member section from view.

10. The listel of claim 9, further comprising:

at least one alignment feature integral with said elongate molded body member to interoperate with an alignment feature on said frame member so as to align said listel with said frame member.

11. The listel of claim 10, wherein said at least one alignment feature comprises at least one boss.

12. The listel of claim 9, further comprising at least one fastener constructed and arranged to secure one or more of said listels to said frame member.

13. The listel of claim 12, wherein the at least one fastener comprises at least one boss coupled to and extending from a side of said listel.

14. The listel of claim 13, wherein an end of said listel is constructed and arranged to abut an end of another listel when said listels are arranged in a plurality of configurations.

15. The listel of claim 14, wherein the end of the listel comprises at least one end having three sides in the form of a half-hexagonal shape.

16. A method for manufacturing a chandelier comprising:

producing a plurality of listels having a predetermined dimension and configuration;

producing a frame assembly including a plurality of interconnected frame members, wherein each of said frame members has one of said predetermined dimension and configuration; and securing said plurality of listels to said frame assembly such that at least one pair of listels substantially surrounds a section of said frame members to which said at least one pair of listels is secured.

17. The method of claim 16, wherein said producing a plurality of listels comprises:

pressing said plurality of listels from at least one mold having said predetermined dimensions.

18. The method of claim 19, wherein said at least one fastener comprises at least one boss coupled to said plurality of listels, and wherein said securing comprises:

fitting said at least one boss into at least one hole in at least one of said plurality of frame members.

19. The method of claim 16, wherein said listel pairs form a listel junction with neighboring listel pairs and wherein said securing comprises:

attaching at least one fastener at said listel junction to hold said plurality of neighboring listels defining said listel junction to said frame member.

20. A method for manufacturing listels for use in a Maria Theresa chandelier having a frame assembly formed from a plurality of integral frame members, the method comprising:

producing a plurality of molded listels each having a predetermined dimension and configuration; and attaching pairs of said listels to opposing sides of sections of said frame members, said frame members having at least one of a same predetermined dimension and a same predetermined configuration as said listels.

21. The lighting fixture of claim 4, wherein said plurality of molded listels are solid listels.

* * * * *